US008768227B2

(12) United States Patent
Urushihara et al.

(10) Patent No.: US 8,768,227 B2
(45) Date of Patent: Jul. 1, 2014

(54) DEVELOPING MEMBER INCLUDING ELASTIC MEMBER CONTAINING CURED PRODUCT OF ADDITION-CURING SILICONE RUBBER MIXTURE, PROCESSING CARTRIDGE INCLUDING THE DEVELOPING MEMBER, AND ELECTROPHOTOGRAPHIC APPARATUS INCLUDING THE DEVELOPING MEMBER

(71) Applicant: Canon Kabushiki Kaisha, Tokyo (JP)

(72) Inventors: Shohei Urushihara, Suntou-gun (JP); Minoru Nakamura, Mishima (JP); Kunimasa Kawamura, Mishima (JP); Masaki Yamada, Mishima (JP); Takashi Kusaba, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 44 days.

(21) Appl. No.: 13/770,796

(22) Filed: Feb. 19, 2013

(65) Prior Publication Data

US 2014/0072350 A1 Mar. 13, 2014

Related U.S. Application Data

(63) Continuation of application No. PCT/JP2012/006120, filed on Sep. 26, 2012.

(30) Foreign Application Priority Data

Sep. 7, 2012 (JP) ..... 2012-196992

(51) Int. Cl.
*G03G 15/08* (2006.01)

(52) U.S. Cl.
USPC ..... 399/286

(58) Field of Classification Search
USPC ..... 399/279, 286
See application file for complete search history.

(56) References Cited

U.S. PATENT DOCUMENTS 5,099,285 A * 3/1992 Hirano et al. ..... 399/286
6,146,320 A 11/2000 Yoshikawa et al.

(Continued)

FOREIGN PATENT DOCUMENTS

| | | | |
|---|---|---|---|
| JP | 4-76577 | A | 3/1992 |
| JP | 11-167246 | A | 6/1999 |
| JP | 11-223987 | A | 8/1999 |
| JP | 2000-265150 | A | 9/2000 |
| JP | 2000-313807 | A | 11/2000 |

(Continued)

*Primary Examiner* — William J Royer
(74) *Attorney, Agent, or Firm* — Fitzpatrick, Cella, Harper and Scinto

(57) ABSTRACT

A developing roller includes: a mandrel; an elastic layer provided for an outer periphery of the mandrel, the elastic layer including an addition-curing silicone rubber; and a surface layer provided for an outer periphery of the elastic layer, in which: the elastic layer includes a compound represented by the following formula (1); when the content of such a compound that n in the formula (1) represents an integer of 3 to 12 in the elastic layer is represented by P1, and the content of such a compound that n in the formula (1) represents an integer of 13 to 20 in the elastic layer is represented by P2, P1+P2 is 5,000 ppm by mass to 12,000 ppm by mass; and P1 is 1,500 ppm by mass to 6,000 ppm by mass (In the formula (1), n represents an integer of 3 to 20):

(1)

10 Claims, 3 Drawing Sheets

(56) References Cited

U.S. PATENT DOCUMENTS

| | | | | |
|---|---|---|---|---|
| 6,201,055 | B1 | 3/2001 | Lutz et al. | |
| 7,580,660 | B2 * | 8/2009 | Sato et al. | 399/286 |
| 7,799,398 | B2 * | 9/2010 | Nakamura et al. | 399/279 |
| 7,881,648 | B2 * | 2/2011 | Yoshida et al. | 399/286 |
| 7,983,605 | B2 * | 7/2011 | Nakamura et al. | 399/286 |

FOREIGN PATENT DOCUMENTS

| | | | |
|---|---|---|---|
| JP | 2001-83797 | A | 3/2001 |
| JP | 2003-128920 | A | 5/2003 |
| JP | 2008-74913 | A | 4/2008 |
| JP | 2008-163282 | A | 7/2008 |
| WO | 03/035762 | A1 | 5/2003 |

* cited by examiner

DEVELOPING MEMBER INCLUDING ELASTIC MEMBER CONTAINING CURED PRODUCT OF ADDITION-CURING SILICONE RUBBER MIXTURE, PROCESSING CARTRIDGE INCLUDING THE DEVELOPING MEMBER, AND ELECTROPHOTOGRAPHIC APPARATUS INCLUDING THE DEVELOPING MEMBER

CROSS-REFERENCE TO RELATED APPLICATIONS

This application is a continuation of International Application No. PCT/JP2012/006120, filed Sep. 26, 2012, which claims the benefit of Japanese Patent Application No. 2012-196992, filed Sep. 7, 2012.

BACKGROUND OF THE INVENTION

1. Field of the Invention

The present invention relates to a developing member to be incorporated into an electrophotographic apparatus, and a process cartridge and an electrophotographic apparatus each using the developing member.

2. Description of the Related Art

A developing member to be used in an electrophotographic apparatus may be used in various temperature environments. Accordingly, a developing member having low temperature dependence has been required. A temperature variation may cause, for example, a change in shape of a developing member due to its thermal expansion. A silicone rubber is suitably used in an elastic layer of a developing member. However, the silicone rubber is more liable to expand thermally than any other rubber is.

It can be said that a variation in size of the elastic layer of a developing member due to its surrounding temperature or humidity is a problem to be solved in order that electrophotographic images having stable quality may be provided. To solve such problem, Patent Literature 1 proposes a silicone rubber composition that provides a silicone rubber having a low expansion coefficient through the addition of an abundance of a silica-based filler having a small surface area. In addition, Patent Literature 2 proposes a silicone rubber composition that provides a silicone rubber having a low viscosity and a low expansion coefficient through the addition of a large amount of silica whose isolated silanol group content has been specified.

CITATION LIST

Patent Literature

PTL 1: Japanese Patent Application Laid-Open No. 2000-265150

PTL 2: Japanese Patent Application Laid-Open No. 2003-128920

SUMMARY OF THE INVENTION

An investigation conducted by the inventors of the present invention has shown that the construction according to any one of Patent Literatures 1 and 2 is expected to exert a suppressing effect on the thermal expansion of a silicone rubber. However, the application of the technology according to any one of Patent Literatures 1 and 2 to a developing member may reduce the elasticity of its elastic layer. As a result, when a member such as a toner control blade abuts on the surface of the developing member over a long time period, a plastic deformation that is not easily recovered (hereinafter, sometimes referred to as "C-set") may occur at the abutting portion in the surface of the developing member. A portion in the developing member where the C-set has occurred is different from any other portion in, for example, toner conveyability. Accordingly, when an electrophotographic image is formed with such developing member, density nonuniformity derived from the C-set may appear in the electrophotographic image.

In view of the foregoing, the present invention is directed to providing a developing member that has reduced the thermal expansion of its elastic layer and hardly causes a plastic deformation even after abutting with an abutting member for a long time period. Further, the present invention is directed to providing a process cartridge and an electrophotographic apparatus conducive to the formation of a high-quality electrophotographic image.

According to one aspect of the present invention, there is provided a developing member, comprising:

a substrate;

an elastic layer provided on the substrate, the elastic layer comprising a cured product of an addition-curing silicone rubber mixture; and a surface layer provided on the elastic layer, wherein:

the elastic layer comprises a compound represented by the following formula (1):

(1)

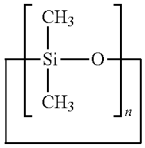

in the formula (1), n represents an integer of 3 or more and 20 or less, and wherein:

when a content of the compound in which n represents an integer of 3 or more and 12 or less in the elastic layer is represented by P1 ppm by mass, and a content of the compound in which n represents an integer of 13 or more and 20 or less in the elastic layer is represented by P2 ppm by mass, P1+P2 is 5,000 ppm by mass or more and 12,000 ppm by mass or less; and P1 is 1,500 ppm by mass or more and 6,000 ppm by mass or less.

According to another aspect of the present invention, there is provided a process cartridge, including: a toner; a toner container storing the toner; and a developing member for carrying the toner in the toner container on a surface thereof and conveying the toner to a developing region, the process cartridge being constituted to be attachable to and detachable from a main body of an electrophotographic apparatus, in which the developing member includes the above-mentioned developing member.

According to the present invention, also provided is an electrophotographic apparatus, including: a toner; a toner container storing the toner; and a developing member for carrying the toner in the toner container on a surface thereof and conveying the toner to a developing region, in which the developing member includes the above-mentioned developing member.

According to the present invention, it is possible to provide the developing member that has reduced the thermal expansion of its elastic layer and hardly causes a plastic deformation at an abutting portion even after abutting with an abutting member for a long time period. According to the present invention, it is also possible to provide the process cartridge and the electrophotographic apparatus conducive to the formation of a high-quality electrophotographic image.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

(Developing Member)

Figure 1:
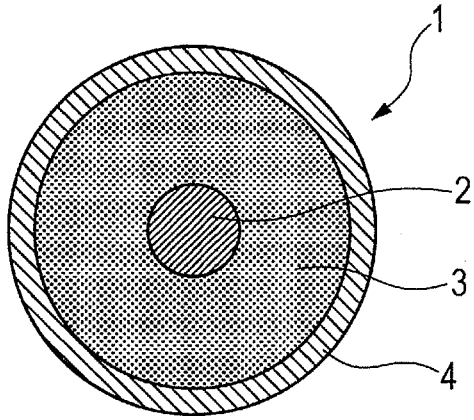
FIG. 1 is a sectional view of an example of a developing roller according to the present invention.

A developing member according to the present invention includes a substrate, an elastic layer, and a surface layer. FIG. 1 illustrates a sectional view in a direction perpendicular to the axis of a roller-shaped developing member, i.e., developing roller according to the present invention. A developing roller 1 illustrated in FIG. 1 is such that an elastic layer 3 is provided for the outer periphery of a mandrel substrate 2 and a surface layer 4 is provided for the outer periphery of the elastic layer 3.

(Substrate)

The substrate functions as an electrode and supporting member for the developing member. Accordingly, the substrate is constituted of, for example, a conductive material such as: a metal or an alloy such as aluminum, a copper alloy, or stainless steel; iron plated with chromium or nickel; or a synthetic resin having conductivity. A hollow or solid substrate can be used as the substrate in the developing member.

(Elastic Layer)

The elastic layer 3 contains a cured product of an addition-curing silicone rubber and contains a compound represented by the following formula (1).

(1)

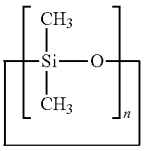

(In the formula (1), n represents an integer of 3 or more and 20 or less.)

<P1, P2, P1+P2>

In the present invention, when the content of such a compound that n in the formula (1) represents an integer of 3 or more and 12 or less in the elastic layer is represented by P1 ppm by mass, and the content of such a compound that n in the formula (1) represents an integer of 13 or more and 20 or less in the elastic layer is represented by P2 ppm by mass, P1+P2 is 5,000 ppm by mass or more and 12,000 ppm by mass or less. Setting the P1+P2 to 5,000 ppm by mass or more can effectively suppress the molecular mobility of the silicone rubber and hence can effectively suppress the thermal expansion of the elastic layer.

In addition, setting the P1+P2 to 12,000 ppm by mass or less can sufficiently suppress a reduction in rubber elasticity due to the entanglement of the silicone rubber as a main component and a cyclic siloxane. Here, the P1+P2 is preferably 6,000 ppm by mass or more and 11,000 ppm by mass or less, particularly preferably 7,000 ppm by mass or more and 10,000 ppm by mass or less, more preferably 8,000 ppm by mass or more and 9,000 ppm by mass or less.

In addition, the P1 is 1,500 ppm by mass or more and 6,000 ppm by mass or less. Setting the P1 to 1,500 ppm by mass or more can sufficiently suppress the occurrence of the plastic deformation, i.e., C-set of the elastic layer. In addition, setting the P1 to 6,000 ppm by mass or less can effectively suppress a reduction in rubber elasticity of the elastic layer due to, for example, the bleeding of the cyclic siloxane toward the developing member. Here, the P1 is set to preferably 2,000 ppm by mass or more and 5,500 ppm by mass or less, particularly preferably 2,500 ppm by mass or more and 5,000 ppm by mass or less, more preferably 3,000 ppm by mass or more and 4,000 ppm by mass or less. It should be noted that the P1 and the P2 can be measured by a method to be described later.

The compound represented by the formula (1) is more rigid than a high-molecular weight polysiloxane having a linear structure. Accordingly, the elastic layer containing the cyclic siloxane represented by the formula (1) at the above-mentioned ratio suppresses a rise of the molecular mobility due to thermal energy even under a high-temperature environment, and hence the thermal expansion of the elastic layer can be suppressed.

In addition, the compound represented by the formula (1) has a lower molecular weight than that of the silicone rubber. Accordingly, a reduction in rubber elasticity due to its entanglement with the silicone rubber hardly occurs. In particular, such compound that n in the formula (1) represents 3 or more and 12 or less has a rigid molecular structure and the structure is hardly changed even by an external pressure. Accordingly, for example, even when a toner control blade or the like abuts on the developing member over a long time period, the occurrence of a plastic deformation that is not easily recovered in the elastic layer can be effectively suppressed.

As described above, the thermal expansion of the elastic layer according to the present invention is suppressed and its plastic deformation hardly occurs. Accordingly, the occurrence of a horizontal streak image resulting from the plastic deformation can also be effectively suppressed.

(Addition-Curing Silicone Rubber Mixture)

The addition-curing silicone rubber mixture to be used as a raw material for the elastic layer of the present invention may contain, for example, the following component (A), component (B), and component (C):

(A) an organopolysiloxane having, in a molecule thereof, at least two alkenyl groups bonded to a silicon atom;

(B) an organopolysiloxane having, in a molecule thereof, at least three hydrogen atoms bonded to a silicon atom; and (C) a platinum-based catalyst.

The molecular structure of the component (A) may be any one of linear and branched structures, and from the viewpoints of satisfactory tensile strength, tear strength, and breaking strength of the cured product, a linear structure is preferred. Examples of the alkenyl group include a vinyl group, an allyl group, a propenyl group, an isopropenyl group, a butenyl group, an isobutenyl group, a pentenyl group, and a hexenyl group. Of those, a vinyl group is preferred as the alkenyl group.

The organopolysiloxane as the component (A) has at least two alkenyl groups, and these alkenyl groups may be identical to each other or different from each other. Examples of the component (A) include a both-terminal-vinyl-sealed polydimethylsiloxane and a polydimethylsiloxane having a side-chain vinyl group. Only one kind of those materials may be used alone, or two or more kinds thereof may be used in combination. The weight-average molecular weight (Mw) of the component (A) is preferably 20,000 or more and 200,000 or less, particularly more preferably 30,000 or more and 150,000 or less.

Here, a weight-average molecular weight (Mw) is defined as a value obtained by measurement involving employing gel permeation chromatography. Specifically, a high-performance liquid chromatograph analyzer (product name: HLC-8120GPC; manufactured by TOSOH CORPORATION) in which two GPC columns (trade name: TSKgel SuperHM-m; manufactured by TOSOH CORPORATION) are connected in series is used. A temperature of 40° C., a flow rate of 0.6 ml/min, and an RI (refractive index) are adopted as measurement conditions, and a tetrahydrofuran (THF) solution containing 0.1 mass % of a measurement sample is subjected to the measurement. Monodisperse standard polystyrenes (trade name: TSK Standard Polystyrene F-128, F-80, F-40, F-20, F-10, F-4, F-2, F-1, A-5000, A-2500, A-1000, and A-500; manufactured by TOSOH CORPORATION) are prepared as standard samples. A calibration curve is created with the standard samples. A molecular weight distribution is obtained from the retention time of the measurement sample or the number of counts. The weight-average molecular weight Mw can be determined from the molecular weight distribution.

The component (A) can be obtained by a known method. The component (A) can be obtained, for example, by using an organocyclopolysiloxane such as a dimethylcyclopolysiloxane or a methylvinylcyclopolysiloxane and a hexaorganodisiloxane such as hexamethyldisiloxane or 1,3-divinyl-1,1,3,3-tetramethyldisiloxane, and subjecting the compounds to an equilibration reaction in the presence of an alkali catalyst or an acid catalyst.

Examples of the component (B) include a methyl hydrogen polysiloxane and an ethyl hydrogen polysiloxane. Only one kind of those materials may be used, or two or more kinds thereof may be used in combination. The hydrogen atom of a hydrosilyl group of the component (B) may be bonded to a silicon atom at a terminal of its molecular chain, or may be bonded to a silicon atom somewhere along the molecular chain. The weight-average molecular weight of the component (B) preferably falls within the range of 300 to 100,000. In addition, the content of the component (B) in the addition-curing silicone rubber composition is preferably such an amount that a molar ratio of the hydrogen atoms bonded to the silicon atom of the component (B) to the alkenyl groups bonded to the silicon atom in the component (A) is 1.0 or more and 10.0 or less. The molar ratio is more preferably 1.0 or more and 3.0 or less.

Examples of the platinum-based catalyst as the component (C) include a platinum fine powder, platinum black, chloroplatinic acid, an alcohol-modified chloroplatinic acid, an olefin complex of chloroplatinic acid, and a complex of chloroplatinic acid and an alkenylsiloxane. Only one kind of those materials may be used, or two or more kinds thereof may be used in combination. The content of the component (C) in the addition-curing silicone rubber composition is preferably such an amount that a ratio of the mass of the catalytic metal atom of the component (C) to the mass of the component (A) is 1 ppm by mass or more and 100 ppm by mass or less.

By the way, the P1 and P2 in the elastic layer of the present invention can be controlled by adjusting at least one of the following items (i) and (ii).

(i) The Content of the Compound Represented by the Formula (1) in the Component (A)

The compound represented by the formula (1) is inevitably produced in a production process for a polysiloxane. In addition, the compound represented by the formula (1) is incorporated in a particularly large amount into the component (A), i.e., the organopolysiloxane having, in a molecule thereof, two or more alkenyl groups bonded to a silicon atom in the addition-curing silicone rubber mixture as a raw material for the elastic layer.

In addition, the compound represented by the formula (1) is volatilized by warming the organopolysiloxane having, in a molecule thereof, two or more alkenyl groups bonded to a silicon atom to a temperature of 60 to 70° C. under a reduced pressure of 0.01 to 0.001 MPa. Therefore, the amounts of the compounds represented by the formula (1) in the component (A), i.e., the content of such compound that n in the formula (1) represents an integer of 3 or more and 12 or less, and the content of such compound that n in the formula (1) represents an integer of 13 or more and 20 or less can be adjusted by adjusting a time for the warming. It should be noted that in the following description, the content of such compound that n in the formula (1) represents an integer of 3 or more and 12 or less in the component (A) is represented by p1 ppm by mass, and the content of such compound that n in the formula (1) represents an integer of 13 or more and 20 or less in the component (A) is represented by p2 ppm by mass.

In addition, the P1 and P2 in the elastic layer can be controlled by using the organopolysiloxane having, in a molecule thereof, two or more alkenyl groups bonded to a silicon atom in which the amounts of the compounds according to the formula (1) have been adjusted as a raw material for the elastic layer.

(ii) the Adjustment of a Curing Temperature and Curing Time for the Addition-Curing Silicone Rubber Mixture The elastic layer is obtained by: forming a layer formed of the addition-curing silicone rubber mixture on the outer peripheral portion of the substrate; and heating the layer to about 100 to 200° C. to cure the layer. In the process as well, the compound according to the formula (1) in the silicone rubber mixture volatilizes. Accordingly, the P1 and the P2 can be controlled also by appropriately adjusting a temperature for the heating and a time for the heating.

For example, suppose that the addition-curing silicone rubber mixture containing the component (A) having a p1 of 19,440 ppm by mass and a p2 of 14,270 ppm by mass is filled into a cylindrical mold having an inner diameter of 12 mm in which a mandrel having an outer diameter of 6 mm is placed. In the case where the mixture is heated to form the elastic layer, setting a temperature for the heating to 115° C. and a time for the heating to 5 minutes can control a ratio (p1/P1) of the p1 to the P1 to 16 to 17% and a ratio (p2/P2) of the p2 to the P2 to about 36 to 37%. In addition, setting the heating temperature to 115° C. and the heating time to 3 minutes can control the ratio p1/P1 to about 30 to 31% and the ratio p2/P2 to about 40 to 41%. Further, setting the heating temperature to 130° C. and the heating time to 5 minutes can control the ratio p1/P1 to 9 to 10% and the ratio p2/P2 to 24 to 25%.

In addition, suppose that the addition-curing silicone rubber mixture containing the component (A) having a p1 of 30,130 ppm by mass and a p2 of 14,050 ppm by mass is filled. In the case where the mixture is heated to form the elastic layer, setting a temperature for the heating to 115° C. and a time for the heating to 5 minutes can control a ratio (p1/P1) of the p1 to the P1 to about 19 to 21% and a ratio (p2/P2) of the p2 to the P2 to about 19 to 21%. In addition, setting the heating temperature to 130° C. and the heating time to 5 minutes can control the ratio p1/P1 to about 11 to 13% and the ratio p2/P2 to about 11 to 13%. Further, setting the heating temperature to 140° C. and the heating time to 3 minutes can control the ratio p1/P1 to about 19 to 20% and the ratio p2/P2 to 2 to 3%.

Further, suppose that the addition-curing silicone rubber mixture containing the component (A) having a p1 of 12,240 ppm by mass and a p2 of 18,510 ppm by mass is filled. In the case where the mixture is heated to form the elastic layer, setting a temperature for the heating to 115° C. and a time for the heating to 5 minutes can control a ratio (p1/P1) of the p1 to the P1 to about 28 to 29% and a ratio (p2/P2) of the p2 to the P2 to about 43 to 44%. In addition, setting the heating temperature to 130° C. and the heating time to 5 minutes can control the ratio p1/P1 to about 13 to 15% and the ratio p2/P2 to about 36 to 38%. Further, setting the heating temperature to 105° C. and the heating time to 10 minutes can control the ratio p1/P1 to 15 to 16% and the ratio p2/P2 to about 51 to 52%.

The elastic layer of the developing member according to the present invention preferably further contains an inorganic filler.

Examples of the inorganic filler include diatomaceous earth, a quartz powder, dry silica, wet silica, titanium oxide, zinc oxide, an aluminosilicate, calcium carbonate, and carbon black. Those inorganic fillers have effects on, for example, the heat resistance, heat transfer, reinforcement, and extension of the rubber. In addition, those inorganic fillers each have a suppressing effect on the thermal expansion of the rubber. Only one kind of those inorganic fillers may be used, or two or more kinds thereof may be used in combination. The inorganic filler preferably has a specific gravity of 1.5 g/cm$^3$ or more and 2.5 g/cm$^3$ or less.

The elastic layer of the developing member according to the present invention contains the inorganic filler at preferably 0.1 mass % or more and 24 mass % or less, particularly preferably 3 mass % or more and 22 mass % or less. Setting the content of the inorganic filler in the elastic layer within the range can suppress a reduction in rubber elasticity such as the thermal expansion and compression set of the elastic layer in an additionally effective manner. It should be noted that the content of the inorganic filler in the elastic layer can be measured by a method to be described later.

In addition to the filler, the elastic layer may contain any of various additives such as a conductive agent, a plasticizer, a vulcanizing agent, a vulcanization aid, a crosslinking aid, an antioxidant, an anti-aging agent, and a processing aid as required, as long as the functions imparted by the above-mentioned composition are not impaired.

As means for dispersing and kneading those raw materials constituting the elastic layer, there are given, for example, methods each using a device such as a single-screw extruder, a twin-screw extruder, a kneader, a two roll mill, a three roll mill, a Banbury mixer, a continuous mixer, or a planetary mixer.

The elastic layer has elasticity which the developing member is required to have. The hardness of the elastic layer can be set to, for example, 20° or more and 80° or less in terms of Asker C hardness. The thickness of the elastic layer can be set to, for example, 1.5 mm or more and 6.0 mm or less.

A mold molding method, an extrusion molding method, an injection molding method, an application molding method, or the like can be given as a method of forming the elastic layer on the mandrel. More specifically, for example, the following methods are given: a method involving extruding the mandrel and a raw material for the elastic layer according to the present invention to mold the elastic layer, and when the raw material is a liquid, a method involving injecting the raw material into a mold, which is obtained by placing a cylindrical pipe and a die for holding the mandrel placed at each of both terminals of the pipe, and heating the material to cure the material. The surface of the elastic layer can be modified by a surface modification method such as surface polishing, a corona treatment, a flame treatment, or an excimer treatment from the viewpoint of an improvement in adhesiveness with the surface layer.

(Surface Layer)

As a material for the surface layer, there are given, for example: a thermoplastic resin such as a styrene-based resin, a vinyl-based resin, a polyether sulfone resin, a polycarbonate resin, a polyphenylene oxide resin, a polyamide resin, a fluorine resin, a cellulose-based resin, or an acrylic resin; and a heat- or photo-curable resin such as an epoxy resin, a polyester resin, an alkyd resin, a phenol resin, a melamine resin, a benzoguanamine resin, a polyurethane resin, a urea resin, a silicone resin, or a polyimide resin. Only one kind of those materials may be used alone, or two or more kinds thereof may be used in combination.

When the developing member needs to have surface roughness, fine particles for roughness control may be added to a dispersion for the surface layer as a raw material for the surface layer. Fine particles made of a polyurethane resin, a polyester resin, a polyether resin, a polyamide resin, an acrylic resin, a polycarbonate resin, or the like can be used as the fine particles for roughness control. Only one kind of those fine particles may be used, or two or more kinds thereof may be used in combination. The fine particles for roughness control preferably have a volume-average particle diameter of 3 μm or more and 20 μm or less. In addition, the content of the fine particles for roughness control in the surface layer is preferably 1 part by mass or more and 50 parts by mass or less with respect to 100 parts by mass of the resin solid content in the surface layer.

Carbon black may be further added to the dispersion for the surface layer as the raw material for the surface layer. Examples of the carbon black include carbon black having high conductivity such as an EC300J or an EC600JD (trade name; manufactured by Lion Corporation) and carbon black for rubber or carbon black for a paint having moderate conductivity. Of those, carbon black for a paint is preferred as the carbon black from the viewpoint of simultaneous control of dispersibility and conductivity. Only one kind of those materials may be used, or two or more kinds thereof may be used in combination. The content of the carbon black in the surface layer is preferably 3 mass % or more and 30 mass % or less with respect to the resin component.

In addition to the above-mentioned additives, the surface layer may contain a crosslinking agent, a plasticizer, a filler, an extender, a vulcanizing agent, a vulcanization aid, a crosslinking aid, an antioxidant, an anti-aging agent, a processing aid, a leveling agent, and the like as long as the function of the surface layer is not impaired.

The thickness of the surface layer is preferably 1 μm or more and 100 μm or less. When the thickness of the surface layer is 1 μm or more, its deterioration due to abrasion or the like can be suppressed. In addition, when the thickness of the surface layer is 100 μm or less, an increase in hardness of the surface of the developing member can be suppressed, the deterioration of toner can be suppressed, and fixation derived from the toner to the surface of the developing member can be suppressed. The thickness of the surface layer is more preferably 1 μm or more and 50 μm or less in consideration of damage to the toner.

Although a method of forming the surface layer is not particularly limited, the surface layer can be formed by, for example, as described below. An application liquid for the surface layer is prepared by dispersing and mixing the respective components of the surface layer in a solvent to turn the components into a paint. The top of the elastic layer is coated with the application liquid for the surface layer and then the liquid is dried to be solidified or is cured. A known dispersing apparatus utilizing beads such as a sand mill, a paint shaker, a DYNO-MILL, or a pearl mill is preferably used in the dispersion and mixing. Dip coating, ring coating, spray coating, roll coating, or the like can be adopted as a method for the coating.

(Process Cartridge and Electrophotographic Apparatus)

A process cartridge according to the present invention is constituted so as to be constituted to be attachable to and detachable from the main body of an electrophotographic apparatus, and includes the developing member according to the present invention. In addition, an electrophotographic apparatus according to the present invention includes the developing member according to the present invention. The process cartridge and electrophotographic apparatus according to the present invention are not limited to a copying machine, a facsimile, a printer, and the like as long as the process cartridge and the electrophotographic apparatus each include the developing member according to the present invention. An electrophotographic apparatus of a nonmagnetic, one-component developing system is described below as an example of the process cartridge and the electrophotographic apparatus each of which is mounted with the developing member according to the present invention.

Figure 2:
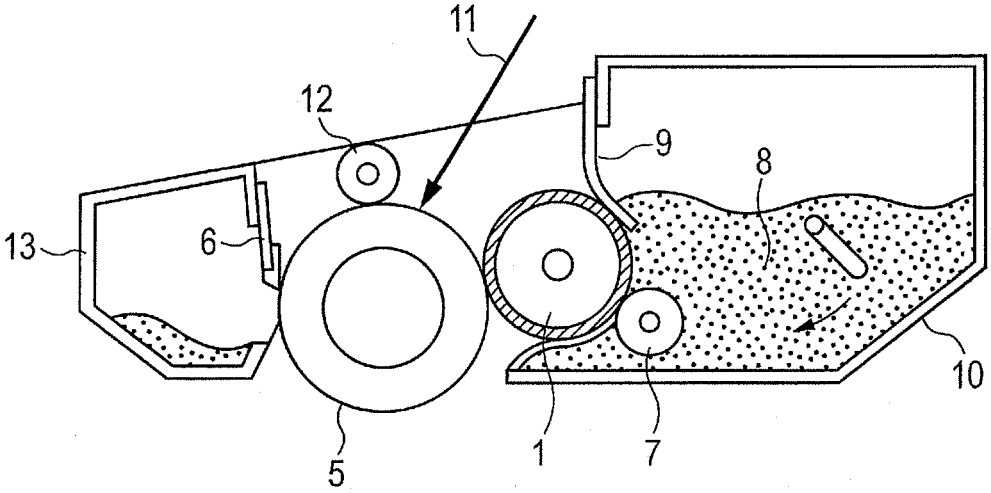
FIG. 2 is a sectional view of an example of a process cartridge according to the present invention.

In a process cartridge illustrated in FIG. 2, a developing device 10 includes: a toner container storing a toner 8 as a nonmagnetic, one-component toner; and a developing roller 1 that is positioned at an opening portion extending in a longitudinal direction in the toner container and is placed so as to be opposite to a photosensitive member 5. In addition, the toner 8 is conveyed to a developing region in a state of being carried on the surface of the developing roller 1, and an electrostatic latent image on the photosensitive member 5 is developed with the toner 8 conveyed by the developing roller 1.

Figure 3:
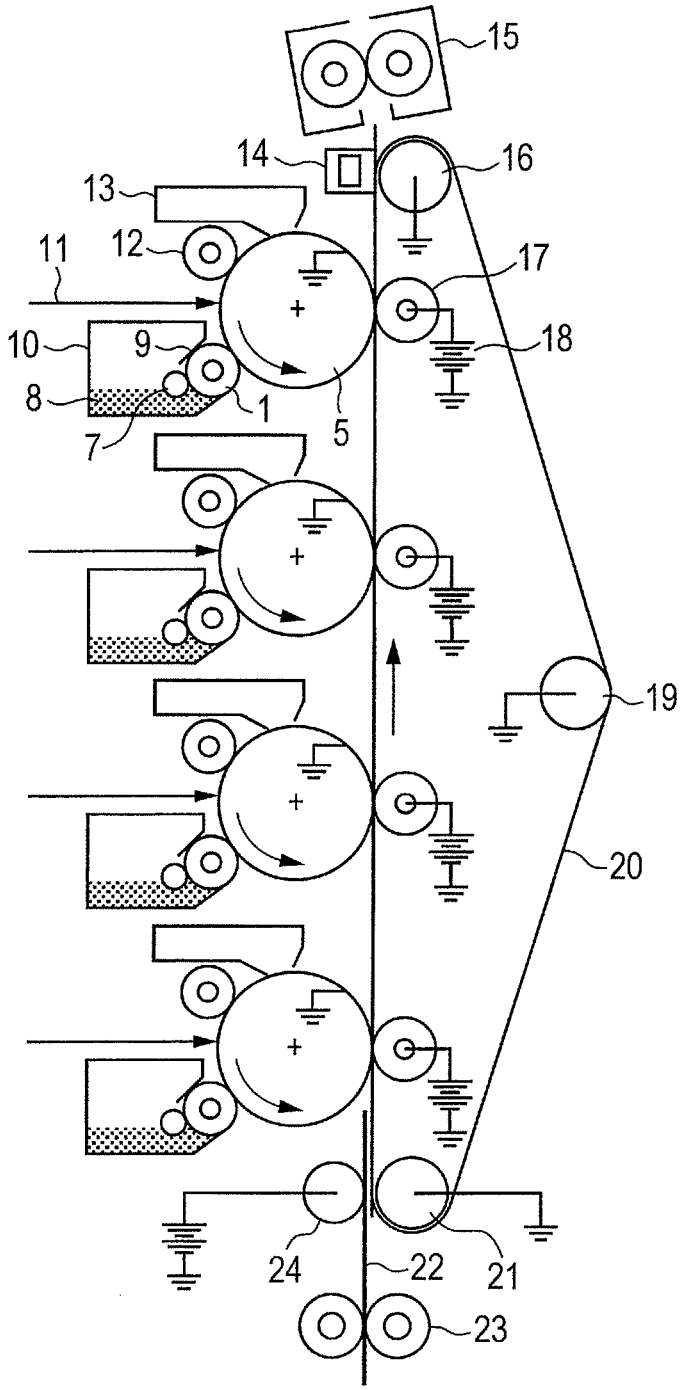
FIG. 3 is a sectional view of an example of an electrophotographic apparatus according to the present invention.

In an electrophotographic apparatus illustrated in FIG. 3, a charging member 12 for charging the surface of the photosensitive member 5, which is rotated by a rotating mechanism (not shown), to a predetermined polarity and potential is placed on the periphery of the photosensitive member 5. Further, an image exposing device (not shown) for subjecting the charged surface of the photosensitive member 5 to image exposure to form an electrostatic latent image is placed. Further, the developing device 10 including the developing roller 1 according to the present invention for adhering toner onto the formed electrostatic latent image to develop the image is placed on the periphery of the photosensitive member 5. Further, a cleaning device 13 for cleaning the top of the photosensitive member 5 after the transfer of a toner image onto paper 22 is provided. A fixing device 15 for fixing the transferred toner image onto the paper 22 is placed on a path along which the paper 22 is conveyed.

Hereinafter, the present invention is described in more detail by way of specific examples, provided that the present invention is not limited to the examples.

<Both-Terminal-Vinyl-Sealed Polydimethylsiloxane A-5>

A both-terminal-vinyl-sealed polydimethylsiloxane (trade name: DMS-V42; manufactured by Gelest, Inc.; weight-average molecular weight Mw=70,000) was prepared as a both-terminal-vinyl-sealed polydimethylsiloxane A-5.

The p1 and p2 in the both-terminal-vinyl-sealed polydimethylsiloxane A-5 were measured by the following method. That is, 1.0 g of the both-terminal-vinyl-sealed polydimethylsiloxane A-5 was immersed in 10 ml of acetone for 24 hours. The supernatant of the extract was analyzed with a gas chromatograph (product name: GC-9A (FID specification); manufactured by Shimadzu Corporation). Such compounds that n in the formula (1) represented 3 to 20 were identified from the resultant MS spectrum and then their amounts were determined from the resultant peak intensities. Table 1 shows the results. It should be noted that the content of such a compound that n in the formula (1) represented an integer of 3 or more and 12 or less was represented by p1 ppm by mass, and the content of such a compound that n in the formula (1) represented an integer of 13 or more and 20 or less was represented by p2 ppm by mass.

<Preparation of Both-Terminal-Vinyl-Sealed Polydimethylsiloxanes A-1 to A-4>

A low-molecular weight siloxane in the both-terminal-vinyl-sealed polydimethylsiloxane A-5 was volatilized by maintaining a state where the both-terminal-vinyl-sealed polydimethylsiloxane A-5 was warmed to a temperature of 60° C. under a reduced pressure of 0.004 MPa for a predetermined time period. Thus, both-terminal-vinyl-sealed polydimethylsiloxanes A-1 to A-4 the p1 and p2 of each of which had values shown in Table 1 were prepared. It should be noted that the warming time was adjusted within the range of 1 to 3 hours.

TABLE 1

| Both-terminal-vinyl-sealed polydimethyl-siloxane component | Weight-average molecular weight [Mw] | Low-molecular weight siloxane amount (ppm by mass) | | |
|---|---|---|---|---|
| | | p1 | p2 | p1 + p2 |
| A-1 | 70,000 | 19,440 | 14,270 | 33,710 |
| A-2 | 70,000 | 30,130 | 14,050 | 44,180 |
| A-3 | 70,000 | 12,240 | 18,510 | 30,750 |
| A-4 | 70,000 | 29,830 | 6,480 | 36,310 |
| A-5 | 70,000 | 42,030 | 25,270 | 67,300 |

Example 1

<Preparation of Mandrel 2>

Prepared as the mandrel 2 was a product obtained by: applying a primer (trade name: DY35-051; manufactured by Dow Corning Toray Co., Ltd.) to a cored bar made of SUS304 having an outer diameter of 6 mm and a length of 250 mm; and baking the primer at 170° C. for 20 minutes.

<Formation of Elastic Layer 3>

The prepared mandrel 2 was placed in a cylindrical mold having an inner diameter of 12 mm so as to be concentric with the mold. An addition-curing silicone rubber composition was prepared as a raw material for the elastic layer by mixing materials shown in Table 2, and then the composition was injected into the mold. After the composition had been heated and molded at 115° C. for 5 minutes, the mold was cooled to 50° C. and then the elastic layer 3 integral with the mandrel 2 was taken out of the mold. Thus, the elastic layer 3 having a diameter of 12 mm was provided for the outer periphery of the mandrel 2.

TABLE 2

| | |
|---|---|
| Both-terminal-vinyl-sealed polydimethylsiloxane A-1 | 100 parts by mass |
| Methyl hydrogen polysiloxane (trade name: HMS-301; manufactured by Gelest, Inc.) | 5 parts by mass |
| Platinum catalyst (trade name: SIP6832.2; manufactured by Gelest, Inc.) | 0.05 part by mass |
| Carbon black (trade name: DENKA BLACK powdery product; manufactured by DENKI KAGAKU KOGYO KABUSHIKI KAISHA) | 3 parts by mass |
| Quartz (trade name: VX-S2; manufactured by TATSUMORI LTD.) | 12.4 parts by mass |

<Formation of Surface Layer 4>

100.0 Parts by mass of a polyester polyol (trade name: Nippolan 3027; manufactured by Nippon Polyurethane Industry Co., Ltd.), 102.6 parts by mass of an MDI-based polyisocyanate (trade name: C2521; manufactured by Nippon Polyurethane Industry Co., Ltd.), and 33.7 parts by mass of carbon black (trade name: MA230; manufactured by Mitsubishi Chemical Corporation) as materials for the surface layer 4 were stirred and mixed. After that, the mixed liquid was dissolved in methyl ethyl ketone (MEK) so that the solid content was 30 mass %, followed by mixing. After that, the contents were uniformly dispersed with a sand mill. MEK was further added to the mixed liquid to adjust the solid content to 25 mass %. 20 Parts by mass of polyurethane resin particles (trade name: Art Pearl C400 (having a volume-average particle diameter of 14 μm); manufactured by Negami Chemical Industrial Co., Ltd.) were added to the mixed liquid, and then the contents were stirred and dispersed with a ball mill. Thus, an application liquid for the surface layer was obtained.

The elastic layer 3 provided for the outer periphery of the mandrel 2 was subjected to dip coating with the application liquid for the surface layer 4. Thus, the application liquid for the surface layer 4 was applied to the surface of the elastic layer 3 so that the thickness of the application liquid was 13 μm. The application liquid was dried in an oven at 80° C. for 15 minutes and then cured in an oven at 140° C. for 1 hour to form the surface layer 4. Thus, the developing roller 1 was produced.

(Measurement of P1 and P2)

1.0 Gram of a sample was cut out of the elastic layer 3 of the resultant developing roller 1. The sample was immersed in 10 ml of acetone for 24 hours. After that, the extract was analyzed with a gas chromatograph as in the analysis of the low-molecular weight siloxane amount. At this time, the content of such a compound that n in the formula (1) represented 3 to 12 in the sample was represented by P1 and the content of such a compound that n in the formula (1) represented 13 to 20 in the sample was represented by P2. Table 4 shows the results.

(Measurement of Content of Inorganic Filler)

The thermogravimetric reduction curve of the resultant developing roller 1 was measured with a simultaneous thermogravimetric-differential thermal analyzer (trade name: Thermo Plus TG8120; manufactured by Rigaku Corporation). Measurement conditions are as described below. An amount between 15 mg and 20 mg of a sample was cut out of the elastic layer 3 of the developing roller 1 and then set in the TG apparatus. After that, oxygen was flowed for 15 minutes or more and then the temperature of the sample was increased to 700° C. at a rate of temperature increase of 20° C./min. The mass % (X) of the residue at the time was calculated. In addition, nitrogen was similarly flowed for 15 minutes or more, and then the temperature was increased to 700° C. at a rate of temperature increase of 20° C./min and held at the value for 10 minutes. After that, the temperature was decreased to 300° C. at a rate of temperature decrease of 20° C./min. After that, oxygen was flowed for 15 minutes or more, and then the temperature was increased to 800° C. at a rate of temperature increase of 20° C./min and held at the value for 10 minutes. After that, a mass reduction amount (mass %) (Y) after the flow of oxygen was calculated. X+Y was calculated as the content (mass %) of an inorganic filler. Table 7 shows the content (mass %) of the inorganic filler.

(Measurement of Expansion Amount)

Figure 4:
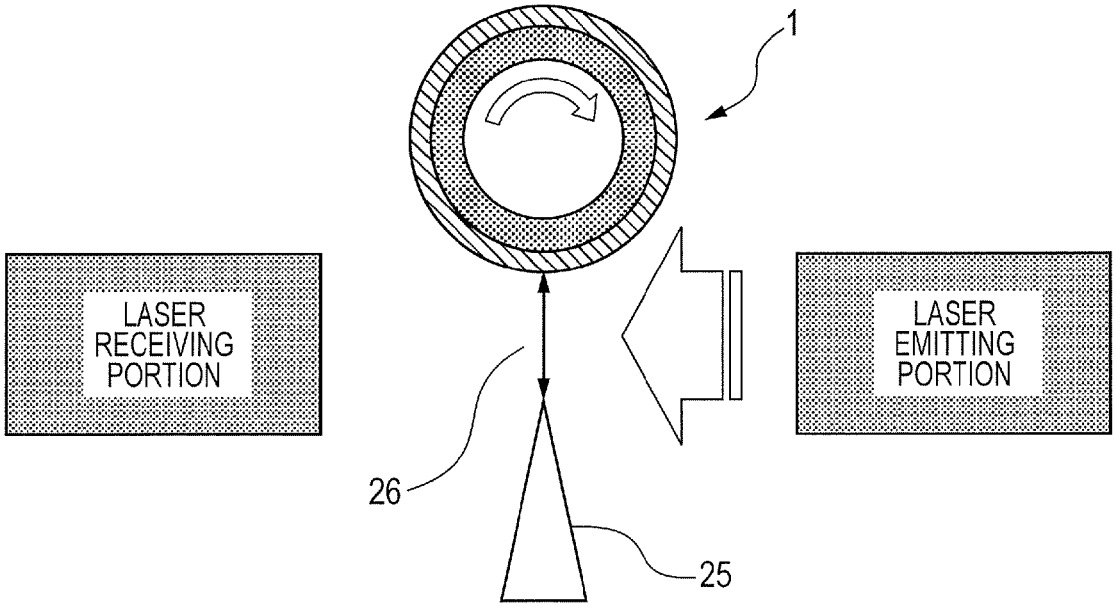
FIG. 4 is a schematic view of a device for measuring the shape of the developing roller according to the present invention.

The outer diameter dimension of the resultant developing roller 1 was measured with a device illustrated in FIG. 4. The device includes a laser dimension-measuring machine (trade name: "LS-7000"; manufactured by KEYENCE CORPORATION) formed of a mandrel receiver (not shown) that rotates with reference to the developing roller 1, an encoder (not shown) for detecting the rotation of the developing roller 1, a reference plate 25, a laser emitting portion, and a laser receiving portion. The outer diameter dimension of the developing roller 1 was calculated by measuring a gap amount 26 between the surface of the developing roller 1 and the reference plate 25. It should be noted that the measurement of the gap amount 26 between the surface of the developing roller 1 and the reference plate 25 was performed for a total of three portions, i.e., a central portion in the longitudinal diction of the elastic layer 3, and positions distant from both end portions of the elastic layer 3 toward the central portion in the longitudinal direction by 5.0 mm each. In addition, the measurement was performed for 360 points at a pitch of 1° with respect to one round of the developing roller 1. The developing roller 1 was left at rest in an environment at 30° C. and a relative humidity of 55% RH for 24 hours before the measurement was performed in the same environment. In addition, the measurement was similarly performed in an environment at 15° C. and a relative humidity of 55%, and a difference between the measured value, and the outer diameter dimension at 30° C. and a relative humidity of 55% RH was defined as an expansion amount (μm). Table 7 shows the result.

(Measurement of Deformation Amount and Horizontal Streak Image Evaluation)

A process cartridge (trade name: EP-85 Toner Cartridge (black); manufactured by Canon Inc.) of a laser beam printer having a construction illustrated in FIG. 3 (trade name: LBP5500; manufactured by Canon Inc.) was prepared. The toner container of the process cartridge was mounted with a toner amount regulating member 9 and the resultant developing roller 1, and then the process cartridge was left at rest under an environment at 40° C. and a relative humidity of 95% RH for 1 month in a state where the developing roller 1 and the toner amount regulating member 9 abutted on each other. It should be noted that a setting was changed to one in which a plastic deformation was liable to occur by adjusting an abutment pressure between the developing roller 1 and the toner amount regulating member 9 to 0.6 N/cm. After that, the process cartridge was left at rest under an environment at 23° C. and a relative humidity of 55% RH for 5 hours. The process cartridge was set in the laser beam printer to output a halftone image, and then the image after the setting was evaluated by criteria shown in Table 3 below.

In addition, the developing roller 1 was taken out of the process cartridge subjected to the evaluation, and then its deformation amount (μm) was measured. It should be noted that the deformation amount of the surface of the developing roller 1 was measured with a laser displacement sensor (trade name: LT-9500V; manufactured by KEYENCE CORPORATION). The deformation amount was measured by: placing the laser displacement sensor in a direction perpendicular to the surface of the developing roller 1 from which the toner had been removed by air blowing; rotationally driving the developing roller 1 at an arbitrary number of revolutions; and reading a displacement in the circumferential direction of the surface of the developing roller 1. The measurement was performed for five points at a pitch of 43 mm in the longitudinal direction and the average of the five measured values was defined as the deformation amount. Table 7 shows the results of the image evaluation and the results of the measurement of the deformation amount.

TABLE 3

| Evaluation rank | Evaluation criterion |
|---|---|
| A | Density nonuniformity is not observed. |
| B | Faint horizontal streaks occur at random. |
| C | Thin horizontal streaks occur in sync with the rotation period of the developing roller. |
| D | Clear horizontal streaks occur in sync with the rotation period of the developing roller. |

Examples 2 to 33 and Comparative Examples 1 to 6

Developing rollers according to Examples 2 to 33 and developing rollers according to Comparative Examples 1 to 6 were produced by the same method as that of Example 1 except that the kind of the polydimethylsiloxane component, the addition amount of quartz, the heat molding temperature, and the heat molding time were changed as shown in Tables 4 to 6. In addition, the respective developing rollers were evaluated in the same manner as in Example 1. Tables 7 to 9 show the results of the evaluation.

TABLE 4

| Example | Polydimethylsiloxane component | Addition amount of quartz (part(s) by mass) | P1 (ppm by mass) | P1 + P2 (ppm by mass) | Heat molding temperature | Heat molding time |
|---|---|---|---|---|---|---|
| 1 | (A-1) | 14 | 3,328 | 8,560 | 115° C. | 5 minutes |
| 2 | (A-1) | 4 | 3,423 | 8,632 | 115° C. | 5 minutes |
| 3 | (A-1) | 22 | 3,135 | 8,345 | 115° C. | 5 minutes |
| 4 | (A-1) | 1 | 3,475 | 8,699 | 115° C. | 5 minutes |
| 5 | (A-1) | 28 | 3,107 | 8,293 | 115° C. | 5 minutes |
| 6 | (A-2) | 14 | 5,812 | 8,594 | 115° C. | 5 minutes |
| 7 | (A-2) | 14 | 3,485 | 5,123 | 130° C. | 5 minutes |
| 8 | (A-3) | 14 | 3,490 | 11,532 | 115° C. | 5 minutes |
| 9 | (A-3) | 14 | 1,623 | 8,352 | 130° C. | 5 minutes |
| 10 | (A-2) | 4 | 5,812 | 6,135 | 140° C. | 3 minutes |
| 11 | (A-1) | 4 | 5,932 | 11,783 | 115° C. | 3 minutes |
| 12 | (A-1) | 4 | 1,783 | 5,324 | 130° C. | 5 minutes |
| 13 | (A-3) | 4 | 1,893 | 11,516 | 105° C. | 10 minutes |
| 14 | (A-2) | 4 | 5,835 | 8,634 | 115° C. | 5 minutes |
| 15 | (A-2) | 4 | 3,586 | 5,281 | 130° C. | 5 minutes |
| 16 | (A-3) | 4 | 3,596 | 11,749 | 115° C. | 5 minutes |
| 17 | (A-3) | 4 | 1,693 | 8,534 | 130° C. | 5 minutes |
| 18 | (A-2) | 22 | 5,763 | 6,096 | 140° C. | 3 minutes |
| 19 | (A-1) | 22 | 5,892 | 11,654 | 115° C. | 3 minutes |
| 20 | (A-1) | 22 | 1,756 | 5,237 | 130° C. | 5 minutes |

TABLE 5

| Example | Polydimethylsiloxane component | Addition amount of quartz (part(s) by mass) | P1 (ppm by mass) | P1 + P2 (ppm by mass) | Heat molding temperature | Heat molding time |
|---|---|---|---|---|---|---|
| 21 | (A-3) | 22 | 1,832 | 11,328 | 105° C. | 10 minutes |
| 22 | (A-2) | 22 | 5,810 | 8,590 | 115° C. | 5 minutes |
| 23 | (A-2) | 22 | 3,470 | 5,130 | 130° C. | 5 minutes |
| 24 | (A-3) | 22 | 3,490 | 11,683 | 115° C. | 5 minutes |
| 25 | (A-3) | 22 | 1,673 | 8,398 | 130° C. | 5 minutes |
| 26 | (A-2) | 1 | 5,897 | 8,764 | 115° C. | 5 minutes |
| 27 | (A-2) | 1 | 3,621 | 5,356 | 130° C. | 5 minutes |
| 28 | (A-3) | 1 | 3,763 | 11,834 | 115° C. | 5 minutes |
| 29 | (A-3) | 1 | 1,735 | 8,673 | 130° C. | 5 minutes |
| 30 | (A-2) | 28 | 5,793 | 8,432 | 115° C. | 5 minutes |
| 31 | (A-2) | 28 | 3,356 | 5,102 | 130° C. | 5 minutes |
| 32 | (A-3) | 28 | 3,387 | 11,632 | 115° C. | 5 minutes |
| 33 | (A-3) | 28 | 1,632 | 8,293 | 130° C. | 5 minutes |

TABLE 6

| Comparative Example | Polydimethylsiloxane component | Addition amount of quartz (part(s) by mass) | P1 (ppm by mass) | P1 + P2 (ppm by mass) | Heat molding temperature | Heat molding time |
|---|---|---|---|---|---|---|
| 1 | (A-4) | 14 | 6,284 | 8,532 | 115° C. | 5 minutes |
| 2 | (A-4) | 14 | 3,532 | 4,632 | 130° C. | 5 minutes |
| 3 | (A-5) | 14 | 3,512 | 12,320 | 115° C. | 10 minutes |
| 4 | (A-5) | 14 | 1,356 | 8,364 | 130° C. | 10 minutes |
| 5 | (A-4) | 42 | 6,210 | 8,432 | 115° C. | 5 minutes |
| 6 | (A-4) | 101 | 6,186 | 8,130 | 115° C. | 5 minutes |

TABLE 7

| Example | Inorganic filler (mass %) | Expansion amount [μm] | Deformation amount [μm] | Horizontal streak image evaluation rank |
|---|---|---|---|---|
| 1 | 13 | 14 | 0.7 | A |
| 2 | 5 | 16 | 0.9 | A |
| 3 | 19 | 13 | 0.8 | A |
| 4 | 3 | 20 | 2.1 | C |
| 5 | 22 | 12 | 2.2 | C |
| 6 | 13 | 13 | 0.9 | A |
| 7 | 13 | 21 | 1.1 | B |
| 8 | 13 | 12 | 0.9 | A |
| 9 | 13 | 15 | 1.3 | B |
| 10 | 5 | 25 | 1.7 | B |
| 11 | 5 | 15 | 1.2 | B |
| 12 | 5 | 23 | 1.9 | B |
| 13 | 5 | 16 | 1.7 | B |
| 14 | 5 | 19 | 1.4 | B |
| 15 | 5 | 24 | 1.7 | B |
| 16 | 5 | 15 | 1.6 | B |
| 17 | 5 | 18 | 1.9 | B |
| 18 | 19 | 20 | 1.5 | B |
| 19 | 19 | 11 | 1.1 | B |
| 20 | 19 | 21 | 1.9 | B |

TABLE 8

| Example | Inorganic filler (mass %) | Expansion amount [μm] | Deformation amount [μm] | Horizontal streak image evaluation rank |
|---|---|---|---|---|
| 21 | 19 | 12 | 1.7 | B |
| 22 | 19 | 14 | 1.6 | B |
| 23 | 19 | 20 | 1.8 | B |
| 24 | 19 | 12 | 1.8 | B |
| 25 | 19 | 15 | 1.9 | B |
| 26 | 3 | 23 | 2.3 | C |
| 27 | 3 | 26 | 2.5 | C |
| 28 | 3 | 19 | 2.4 | C |
| 29 | 3 | 24 | 2.7 | C |
| 30 | 22 | 12 | 2.3 | C |
| 31 | 22 | 15 | 2.5 | C |
| 32 | 22 | 9 | 2.4 | C |
| 33 | 22 | 13 | 2.7 | C |

TABLE 9

| Comparative Example | Inorganic filler (mass %) | Expansion amount [μm] | Deformation amount [μm] | Horizontal streak image evaluation rank |
|---|---|---|---|---|
| 1 | 13 | 17 | 3.4 | D |
| 2 | 13 | 33 | 3.3 | D |
| 3 | 13 | 11 | 3.1 | D |
| 4 | 13 | 20 | 3.5 | D |
| 5 | 30 | 13 | 3.5 | D |
| 6 | 50 | 8 | 4.5 | D |

As is apparent from the results shown in Tables 7 to 9, a good electrophotographic image was obtained in each of Examples 1 to 33 because the expansion amount was small and the deformation amount was also small. This may be because of the following reason. The P1 and the P1+P2 existed in proper ranges. As a result, the expansion of the elastic layer 3 due to heat was reduced without any reduction of its rubber elasticity. Accordingly, its plastic deformation was able to be reduced, and the occurrence of a horizontal streak image resulting from the plastic deformation and in sync with the pitch of the developing roller was able to be suppressed.

On the other hand, in each of the developing rollers of Comparative Examples 1 to 6, the deformation amount was large and a horizontal streak resulting from a plastic deformation was remarkably observed to occur in sync with the rotation period of the developing roller. This may be because the P1 or the P1+P2 deviated from the proper range and hence the deformation amount of the developing roller due to its press contact with an abutting member enlarged.

The thermal expansion of the developing roller of Comparative Example 2 was particularly large. This may be because the P1+P2, in particular, deviated from the proper range and hence the molecular motion of the silicone rubber composition could not be suppressed.

The deformation amount of the developing roller of Comparative Example 6 was particularly large. This may be because of the following reason. The P1 deviated from the proper range and the content of the inorganic filler was excessive. As a result, the rubber elasticity reduced despite the suppression of the thermal expansion. Accordingly, the deformation amount enlarged.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-196992, filed Sep. 7, 2012, which is hereby incorporated by reference herein in its entirety.

| Reference Signs List | |
|---|---|
| 1 | developing member (developing roller) |
| 2 | mandrel substrate |
| 3 | elastic layer |
| 4 | surface layer |
| 5 | photosensitive member |
| 6 | cleaning member |
| 7 | toner supplying roller |
| 8 | toner |
| 9 | toner amount regulating member |
| 10 | developing device |
| 11 | laser light |
| 12 | charging member |
| 13 | cleaning device |
| 14 | charging device for cleaning |
| 15 | fixing device |
| 16 | driving roller |

-continued

| Reference Signs List | |
|---|---|
| 17 | transfer roller |
| 18 | bias power source |
| 19 | tension roller |
| 20 | transfer conveyance belt |
| 21 | driven roller |
| 22 | paper |
| 23 | sheet feeding roller |
| 24 | adsorbing roller |
| 25 | reference plate |
| 26 | gap amount |

What is claimed is:

1. A developing member, comprising:

a substrate;

an elastic layer provided on the substrate, the elastic layer comprising a cured product of an addition-curing silicone rubber mixture; and a surface layer provided on the elastic layer, wherein:

the elastic layer comprises a compound represented by the following formula (1):

(1)

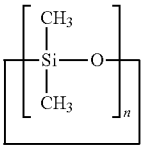

in the formula (1), n represents an integer of 3 or more and 20 or less, and wherein:

when a content of the compound in which n represents an integer of 3 or more and 12 or less in the elastic layer is represented by P1 ppm by mass, and a content of the compound in which n represents an integer of 13 or more and 20 or less in the elastic layer is represented by P2 ppm by mass, P1+P2 is 5,000 ppm by mass or more and 12,000 ppm by mass or less; and P1 is 1,500 ppm by mass or more and 6,000 ppm by mass or less.

2. The developing member according to claim 1, wherein the P1+P2 is 6,000 ppm by mass or more and 11,000 ppm by mass or less.

3. The developing member according to claim 2, wherein the P1+P2 is 7,000 ppm by mass or more and 10,000 ppm by mass or less.

4. The developing member according to claim 1, wherein the P1 is 2,000 ppm by mass or more and 5,500 ppm by mass or less.

5. The developing member according to claim 4, wherein the P1 is 2,500 ppm by mass or more and 5,000 ppm by mass or less.

6. The developing member according to claim 1, wherein the addition-curing silicone rubber mixture comprises the following component (A), component (B), and component (C):

(A) an organopolysiloxane having, in a molecule thereof, at least two alkenyl groups bonded to a silicon atom;

(B) an organopolysiloxane having, in a molecule thereof, at least three hydrogen atoms bonded to a silicon atom; and (C) a platinum-based catalyst.

7. The developing member according to claim 6, wherein the component (A) has a weight-average molecular weight of 20,000 or more and 200,000 or less.

8. The developing member according to claim 1, wherein the elastic layer comprises an inorganic filler at a ratio of 0.1 mass % or more and 24 mass % or less.

9. A process cartridge, comprising:

a toner;

a toner container storing the toner; and a developing member for carrying the toner in the toner container on a surface thereof and conveying the toner to a developing region, the process cartridge being constituted to be attachable to and detachable from a main body of an electrophotographic apparatus, wherein the developing member comprises the developing member according to claim 1.

10. An electrophotographic apparatus, comprising:

a toner;

a toner container storing the toner; and a developing member for carrying the toner in the toner container on a surface thereof and conveying the toner to a developing region, wherein the developing member comprises the developing member according to claim 1.

* * * * *